US005435086A

United States Patent [19]

Huang

[11] Patent Number: 5,435,086

[45] Date of Patent: Jul. 25, 1995

[54] REVOLVING AND SELF-ROTATING LIQUID-CONTAINING DECORATION

[76] Inventor: Jer-Fu Huang, No. 80, Taya Road, Taichung City, Taiwan

[21] Appl. No.: 289,249

[22] Filed: Aug. 11, 1994

[51] Int. Cl.[6] ..... G09F 19/02

[52] U.S. Cl. ..... 40/426; 40/415; 446/136

[58] Field of Search ..... 446/134, 135, 136, 366, 446/352, 303; 472/129, 6, 12, 19; 40/411, 414, 415, 426, 427, 429, 430, 435, 456

[56] References Cited

U.S. PATENT DOCUMENTS

| | | | |
|---|---|---|---|
| 631,306 | 8/1899 | Hollingsworth | 40/415 |
| 1,323,902 | 12/1919 | Obolewicz | 40/415 X |
| 2,092,927 | 9/1937 | Merwitz | 40/426 |
| 2,282,430 | 5/1942 | Smith | 40/426 |
| 3,006,111 | 10/1961 | Koch | 446/136 |

*Primary Examiner*—Kenneth T. Dorner
*Assistant Examiner*—Joanne Silbermann
*Attorney, Agent, or Firm*—Bacon & Thomas

[57] ABSTRACT

A revolving and self-rotating liquid-containing decoration comprising a freely shaped transparent container containing a liquid, a concave driving disk made of magnetic material and disposed in the liquid, a freely shaped decorative article disposed on the driving disk, a hollow base disposed under a smooth and plane bottom board of the container and a power assembly disposed in the base, wherein the power assembly drives the driving disk to revolve in the liquid contained in the container and when revolving, the driving disk and the decorative article simultaneously self-rotate due to velocity difference between a peripheral portion and a central portion of the driving disk.

1 Claim, 6 Drawing Sheets

REVOLVING AND SELF-ROTATING LIQUID-CONTAINING DECORATION

BACKGROUND OF THE INVENTION

The present invention relates to a revolving and self-rotating liquid-containing decoration.

Various kinds of liquid-containing decorations are commercially available nowadays. Such decorations have monotonous appearance and cannot create an amazingly pleasing effect. Therefore, it is necessary to provide an improved liquid-containing decoration which possesses inventive features and is capable of creating unique and distinct pleasing effects.

SUMMARY OF THE INVENTION

It is therefore a primary object of the present invention to provide a revolving and self-rotating liquid-containing decoration which performs the decorative function in a manner totally different from that of a conventional liquid-containing decoration so as to achieve a distinct pleasing effect. The present liquid-containing decoration includes a container containing a liquid, a driving disk disposed in the liquid and a decorative article disposed on the driving disk. The driving disk is spacedly driven by a power assembly located in a base disposed under a bottom board of the container. The driving disk contacts with the bottom board at a central point with minimized frictional force, whereby the power assembly drives the driving disk to revolve in the liquid contained in the container and when revolving, the driving disk and the decorative article simultaneously self-rotate due to velocity difference between a peripheral portion and a central portion of the driving disk.

The present invention can be best understood through the following description and accompanying drawing, wherein:

DETAILED DESCRIPTION OF THE PREFERRED EMBODIMENT

Figure 1:
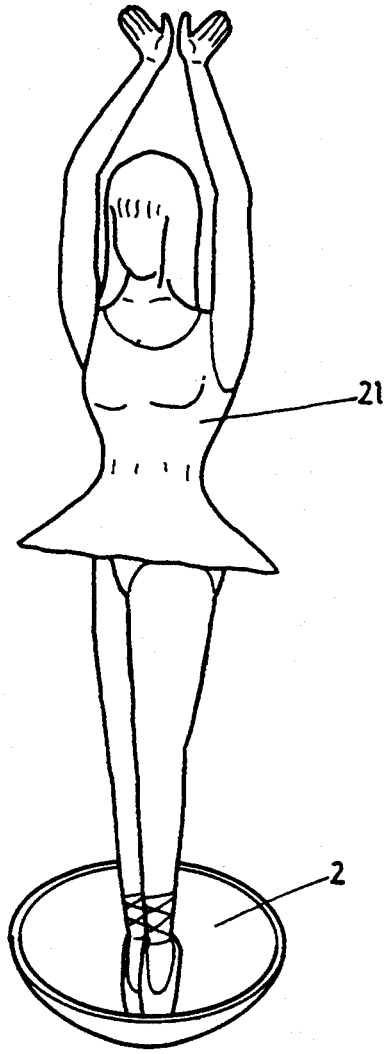
FIG. 1 is a perspective view of the decorative article and driving disk of the present invention.
Figure 2:
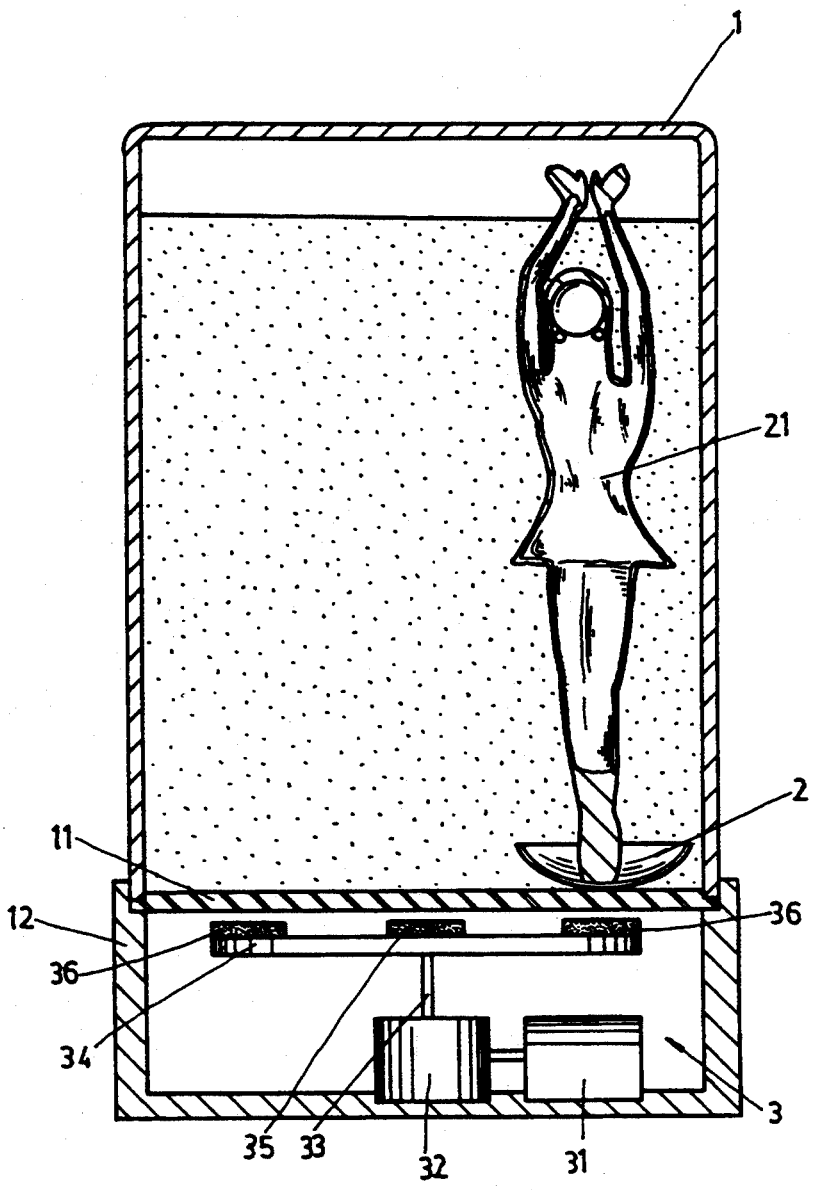
FIG. 2 is a sectional view of the present invention.
Figure 3:
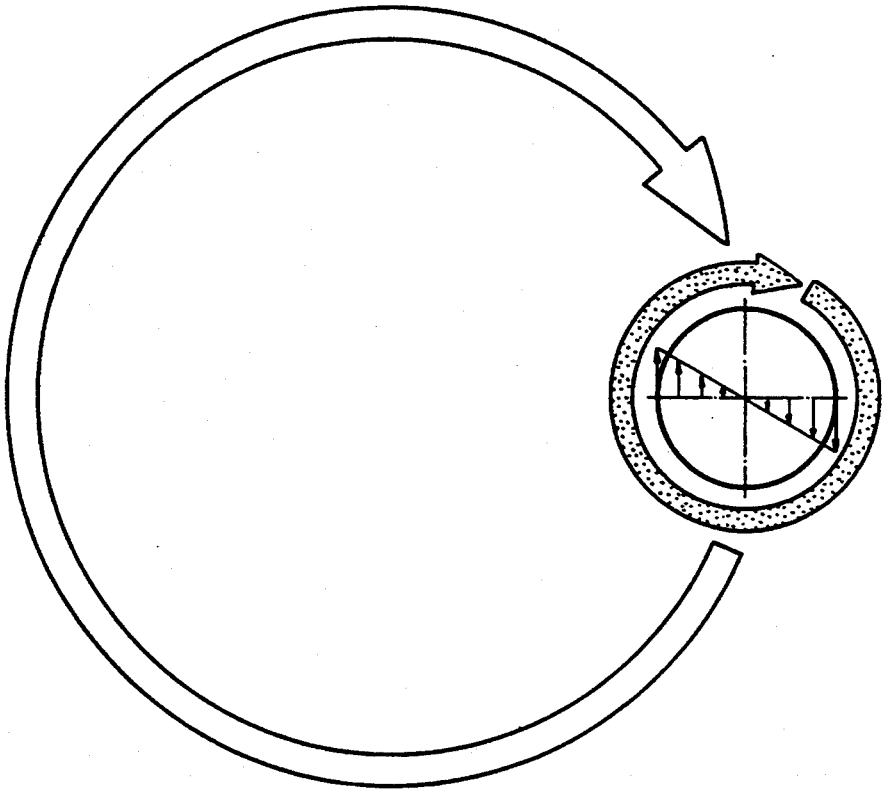
FIG. 3 shows the velocity between the peripheral portion and central portion of the driving disk and the revolving trace and self-rotating trace thereof.
Figure 4:
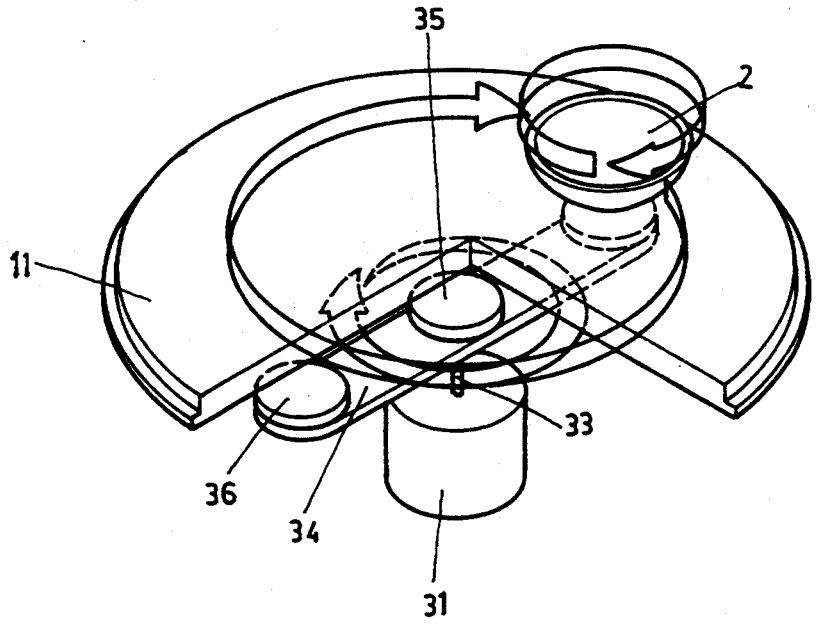
FIG. 4 shows the relationship between the movements of the driving disk and power assembly of the present invention.
Figure 5:
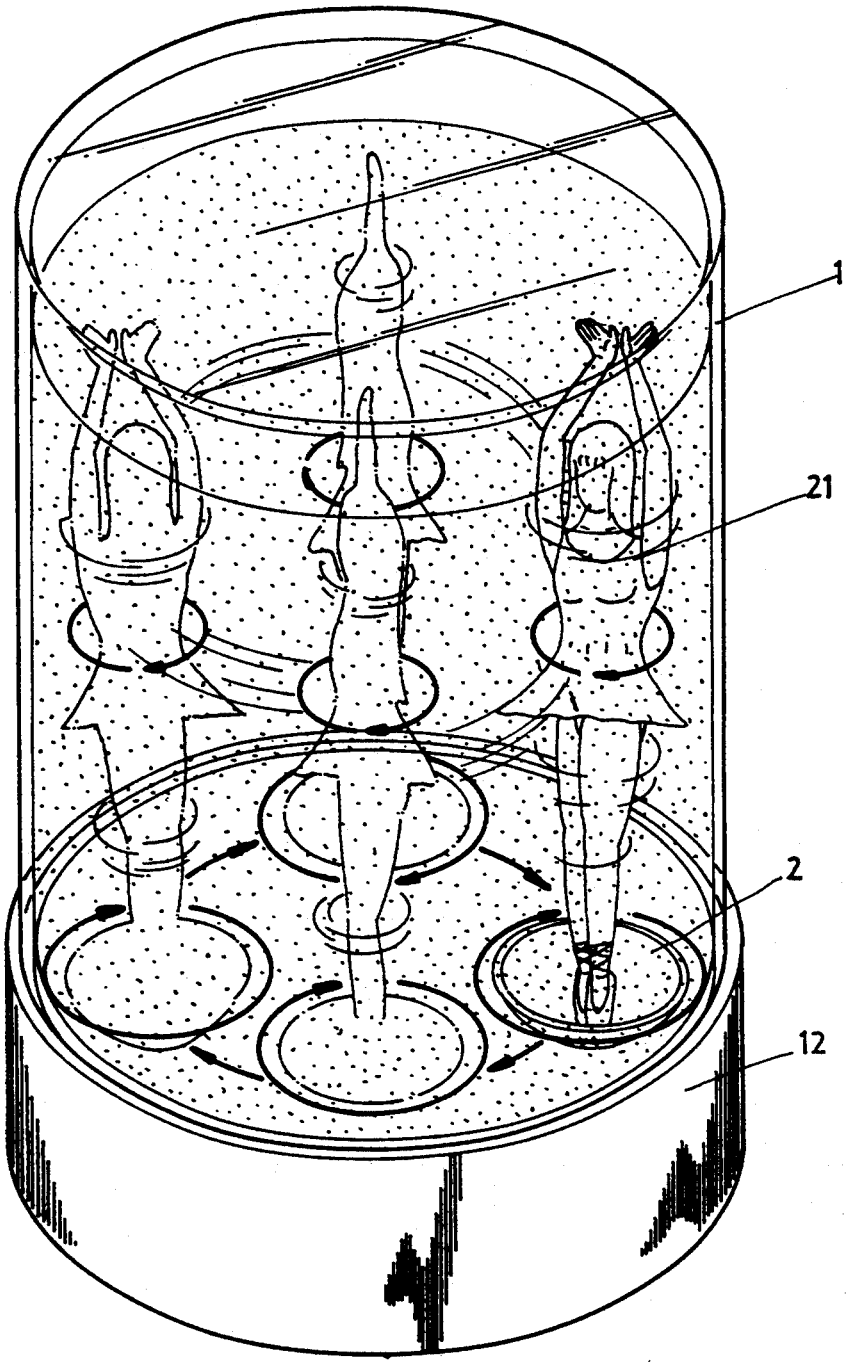
FIG. 5 shows one embodiment of the decorative article of the present invention.
Figure 6:
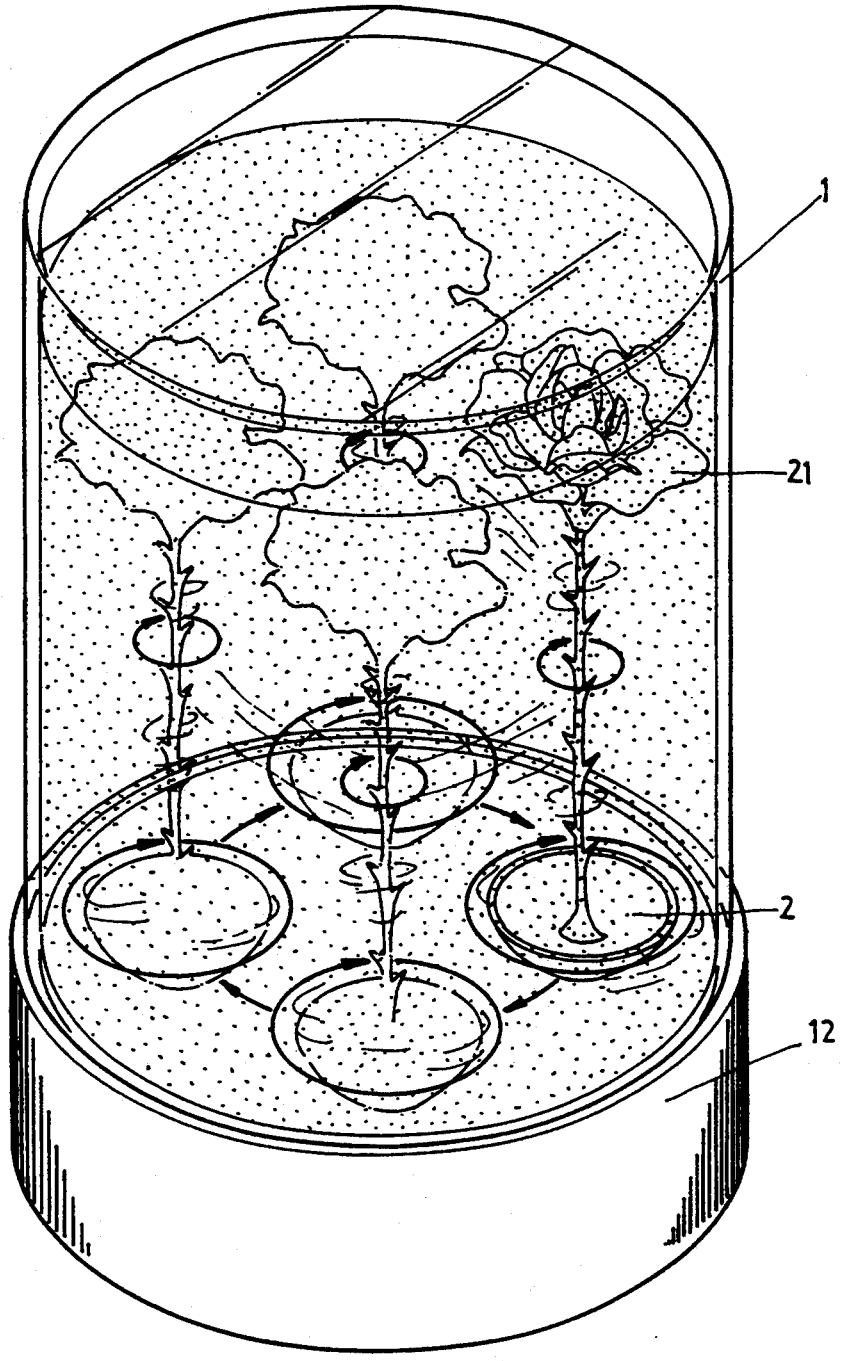
FIG. 6 shows another embodiment thereof.

Please refer to FIGS. 1 and 2. The present invention includes a freely shaped transparent container 1 containing a liquid 4, a concave driving disk 2 made of magnetic material and disposed in the liquid, a freely shaped decorative article 21 disposed on the driving disk 2 (such as a ballerina, blooming flowers, spiral leaves, an upright tube body, etc.), a hollow base 12 disposed under a smooth and plane bottom board 11 of the container 1 and a power assembly 3 disposed in the base 12. In order to keep the decorative article 21 upright, an upper portion of the decorative article 21 can be hollow or a buoyant member 9 can be added to a top end of the decorative article 21 so as to maintain the normally upright state of the decorative article 21 while preventing the same from suspending in the liquid 4 contained in the container 1. The power assembly 3 includes a motor 31 for driving an idler 32, a shaft 33 connected with the idler 32 and driven by the motor 31 along with the idler 32, a vane 34 disposed above and connected with the shaft 33 and driven by the motor 31 along with the shaft 33, a first magnet 35 disposed on a central portion of the vane 34 and two second magnets 36 disposed on two lateral sides of the vane 34. The magnets 35, 36 are disposed in cooperation with the driving disk 2. If the S pole of the driving disk 2 faces downward, then the S pole of the first magnet 35 faces upward and the N pole of the second magnet 36 faces upward. Reversely, if the N pole of the driving disk 2 faces downward, then the N pole of the first magnet 35 faces upward and the S pole of the second magnet 36 faces upward. According to the above arrangements and the principle of magnetic polarity, when the vane 34 of the power assembly 3 in the base 12 is driven to slowly rotate, the driving disk 2 is spacedly attracted by the second magnet 36 and displaced along therewith. However, the driving disk 2 is prevented from moving toward a central portion of the bottom board 11 of the container 1 and stopping there. In addition, because the driving disk 2 is concave and contacts with the plane bottom board 11 at a lowest point, the contacting area between the driving disk 2 and the bottom board 11 is quite small. Moreover, the decorative article 21 is slightly lifted by the buoyancy of the liquid 4 contained in the container 1 so that the frictional force between the driving disk 2 and the bottom board 11 is minimized. This permits the driving disk 2 to be spacedly driven by the vane 34 to revolve through a trace X5 in the container 1 as shown in FIGS. 3 and 4, wherein the contacting point 20 between the driving disk 2 and the bottom board 11 is enlarged. When the contacting point 20 (or driving disk 2) revolves through the trace X, a peripheral portion of the driving disk 2 must travel at a velocity greater than that of a central portion of the driving disk 2 so as to achieve the revolving state of the driving disk 2 through the trace X. However, the frictional force at the contacting point 20 is minimized, so that the difference of velocity between the peripheral portion and central portion of the driving disk 2 will make the driving disk 2 self-rotate about the contacting point 20 through a trace Y6, that is, when the driving disk 2 is driven by the second magnet 36 of the vane 34 to revolve through the trace X, the driving disk 2 will simultaneously self-rotate through the trace Y due to the difference of velocity. Such combination of two types of traces is like the movement of the earth around the sun. Therefore, the decorative article 21 disposed on the driving disk 2 moves in both revolving and self-rotating patterns as shown in FIG. 5. The profile and appearance of the decorative article 21 are not limited so that various kinds of performances of the decorative article 21 are available to achieve great amusing and pleasing effect.

It is to be understood that the above description and drawings are only used for illustrating one embodiment of the present invention, not intended to limit the scope thereof. Any variation and derivation from the above description and drawings should be included in the scope of the present invention.

What is claimed is:

1. A revolving and self-rotating liquid-containing decoration comprising a freely shaped transparent container containing a liquid, a concave driving disk made of magnetic material and disposed in the liquid, a freely shaped decorative article disposed on the driving disk, a hollow base disposed under a smooth and plane bottom board of the container and a power assembly disposed in the base, wherein an upper portion of the decorative article is hollow or a buoyant member is added to a top end of the decorative article so as to keep the same in an upright state without suspending in the liquid contained in the container, the power assembly including a motor, an idler driven by the motor, a shaft connected with the idler and driven by the motor along with the idler, a vane disposed above and connected with the shaft and driven by the motor along with the shaft, a first magnet disposed on a central portion of the vane for spacedly repelling the driving disk and two second magnets disposed on two lateral sides of the vane for spacedly attracting the driving disk, whereby when the vane of the power assembly is driven to slowly rotate, the driving disk is attracted by the second magnet of the vane and revolves along therewith without moving toward a central portion of the bottom board of the container and stopping there, and the concave driving disk contacts with the plane bottom board at a lowest point of the driving disk and the decorative article is slightly lifted by the buoyancy of the liquid contained in the container so that the frictional force between the driving disk and the bottom board is minimized, whereby when revolving, the driving disk and the decorative article will simultaneously self-rotate.

* * * * *